US009753415B2

(12) United States Patent
Okura

(10) Patent No.: US 9,753,415 B2
(45) Date of Patent: Sep. 5, 2017

(54) IMAGE FORMING APPARATUS

(71) Applicant: KYOCERA Document Solutions Inc., Osaka (JP)

(72) Inventor: Tomohisa Okura, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/073,971

(22) Filed: Mar. 18, 2016

(65) Prior Publication Data

US 2016/0282772 A1 Sep. 29, 2016

(30) Foreign Application Priority Data

Mar. 26, 2015 (JP) ..... 2015-064950

(51) Int. Cl.
*G03G 15/16* (2006.01)

(52) U.S. Cl.
CPC ..... *G03G 15/1685* (2013.01); *G03G 15/1675* (2013.01); *G03G 2215/1623* (2013.01)

(58) Field of Classification Search
CPC .... G03G 15/00; G03G 15/02; G03G 15/0266; G03G 15/0283; G03G 2215/00535; G03G 2215/00367; G03G 2215/00409; G03G 2215/00371; G03G 15/1685; G03G 15/1675
See application file for complete search history.

(56) References Cited

U.S. PATENT DOCUMENTS 3,885,870 A * 5/1975 Levy ..... G03G 15/26 399/136
4,338,017 A * 7/1982 Nishikawa ..... G03G 15/1675 399/145
5,198,864 A * 3/1993 Fletcher ..... G03G 15/1695 399/314
5,884,133 A * 3/1999 Morimoto ..... G03G 15/167 399/121
8,005,412 B2 * 8/2011 Sakashita ..... G03G 15/1675 399/315
2002/0064405 A1 * 5/2002 Tomiki ..... G03G 15/6558 399/316
2002/0181963 A1 * 12/2002 Takeda ..... B41J 11/009 399/45
2005/0201775 A1 * 9/2005 Ikeda ..... G03G 21/00 399/101
2011/0103861 A1 * 5/2011 Kakehi ..... G03G 15/1605 399/400

(Continued)

FOREIGN PATENT DOCUMENTS

JP 05249838 A * 9/1993
JP 05249839 A * 9/1993

(Continued)

*Primary Examiner* — David Banh
(74) *Attorney, Agent, or Firm* — Wenderoth, Lind & Ponack, L.L.P.

(57) ABSTRACT

An application voltage to a conveyance auxiliary roller is controlled to have a polarity opposite to a charged polarity of toner before a front end of a sheet makes contact with the conveyance auxiliary roller, and the application voltage to the conveyance auxiliary roller is switched to a ground voltage before a rear end of the sheet is separated from the conveyance auxiliary roller after being separated from a conveying belt.

2 Claims, 7 Drawing Sheets

(56) References Cited

U.S. PATENT DOCUMENTS

| | | | | |
|---|---|---|---|---|
| 2011/0110692 | A1* | 5/2011 | Ideguchi | G03G 15/161 399/312 |
| 2012/0002996 | A1* | 1/2012 | Izumi | G03G 15/161 399/88 |
| 2012/0099907 | A1* | 4/2012 | Ideguchi | G03G 15/1605 399/315 |
| 2012/0230746 | A1* | 9/2012 | Namisaki | G03G 15/2085 399/400 |
| 2012/0321332 | A1* | 12/2012 | Yanagi | G03G 15/1605 399/66 |
| 2013/0330093 | A1* | 12/2013 | Kakehi | G03G 15/2028 399/16 |
| 2014/0064761 | A1* | 3/2014 | Hayashi | G03G 15/1675 399/66 |
| 2015/0378285 | A1* | 12/2015 | Michishita | G03G 15/1665 399/314 |

FOREIGN PATENT DOCUMENTS

| | | | |
|---|---|---|---|
| JP | 7-64421 | | 3/1995 |
| JP | 2007094343 | A * | 4/2007 |

* cited by examiner

IMAGE FORMING APPARATUS

CROSS-REFERENCE TO RELATED APPLICATION

This application is based upon and claims the benefit of priority from Japanese Patent Application No. 2015-064950 filed on Mar. 26, 2015, the entire contents of which are incorporated herein by reference.

BACKGROUND

The technology of the present disclosure relates to an image forming apparatus.

Conventionally, there has been known an image forming apparatus including a photosensitive drum, a conveying belt for conveying a sheet, and a transfer roller brought into press-contact with the photosensitive drum while interposing the conveying belt between the photosensitive drum and the transfer roller. The aforementioned sheet is conveyed to a downstream side while being interposed by the conveying belt and the photosensitive drum. The transfer roller receives a transfer voltage with a polarity opposite to a charged polarity of toner when the sheet passes through a nip position formed between the conveying belt and the photosensitive drum. In this way, a toner image carried on the photosensitive drum is transferred to the sheet. At a downstream side in a sheet conveyance direction of the aforementioned nip position, a stretching roller is provided. The stretching roller stretches the conveying belt at a separation position at which the sheet is separated from the conveying belt.

In this type of image forming apparatus, the rear end of the sheet jumps to the photosensitive drum side by a conveyance attitude of the sheet when the sheet passes through the separation position. As a consequence, there is a problem that toner carried on the sheet scatters.

There have been proposed various technologies for preventing such toner scattering. In an example of these technologies, a conveyance auxiliary roller is provided in the vicinity of the downstream side of the aforementioned separation position to assist the conveyance of the sheet, so that the conveyance attitude of the sheet passing through the separation position is stabilized. In this way, the jumping-up of the rear end of the above-described sheet is suppressed. The conveyance auxiliary roller includes a conductive member and is grounded.

SUMMARY

An image forming apparatus according to one aspect of the present disclosure includes an image carrying member, a conveying belt, a transfer roller, a stretching roller, and a conveyance auxiliary roller. The image carrying member carries a toner image. The conveying belt forms a nip in contact with the aforementioned image carrying member and conveys a sheet via a nip position. The transfer roller transfers the aforementioned toner image to the aforementioned sheet at the aforementioned nip position. The aforementioned stretching roller stretches the aforementioned conveying belt at a downstream side in a sheet conveyance direction of the aforementioned nip position. The aforementioned conveyance auxiliary roller is provided in the vicinity of a downstream side of the stretching roller and supports the aforementioned sheet from below.

Furthermore, the aforementioned image forming apparatus further includes a voltage application part and a control unit. The voltage application part applies a voltage to the aforementioned conveyance auxiliary roller. The aforementioned control unit controls an application voltage which is applied to the aforementioned conveyance auxiliary roller by the aforementioned voltage application part. The aforementioned control unit is configured to control the application voltage to the aforementioned conveyance auxiliary roller to have a polarity opposite to a charged polarity of toner before a front end of the aforementioned sheet makes contact with the aforementioned conveyance auxiliary roller, and to switch the application voltage to the aforementioned conveyance auxiliary roller to a ground voltage before a rear end of the aforementioned sheet is separated from the aforementioned conveyance auxiliary roller after being separated from the aforementioned conveying belt.

DETAILED DESCRIPTION

Hereinafter, an example of an embodiment will be described in detail on the basis of the drawings. It is noted that the technology of the present disclosure is not limited to the following embodiments.

Embodiment

Figure 1:
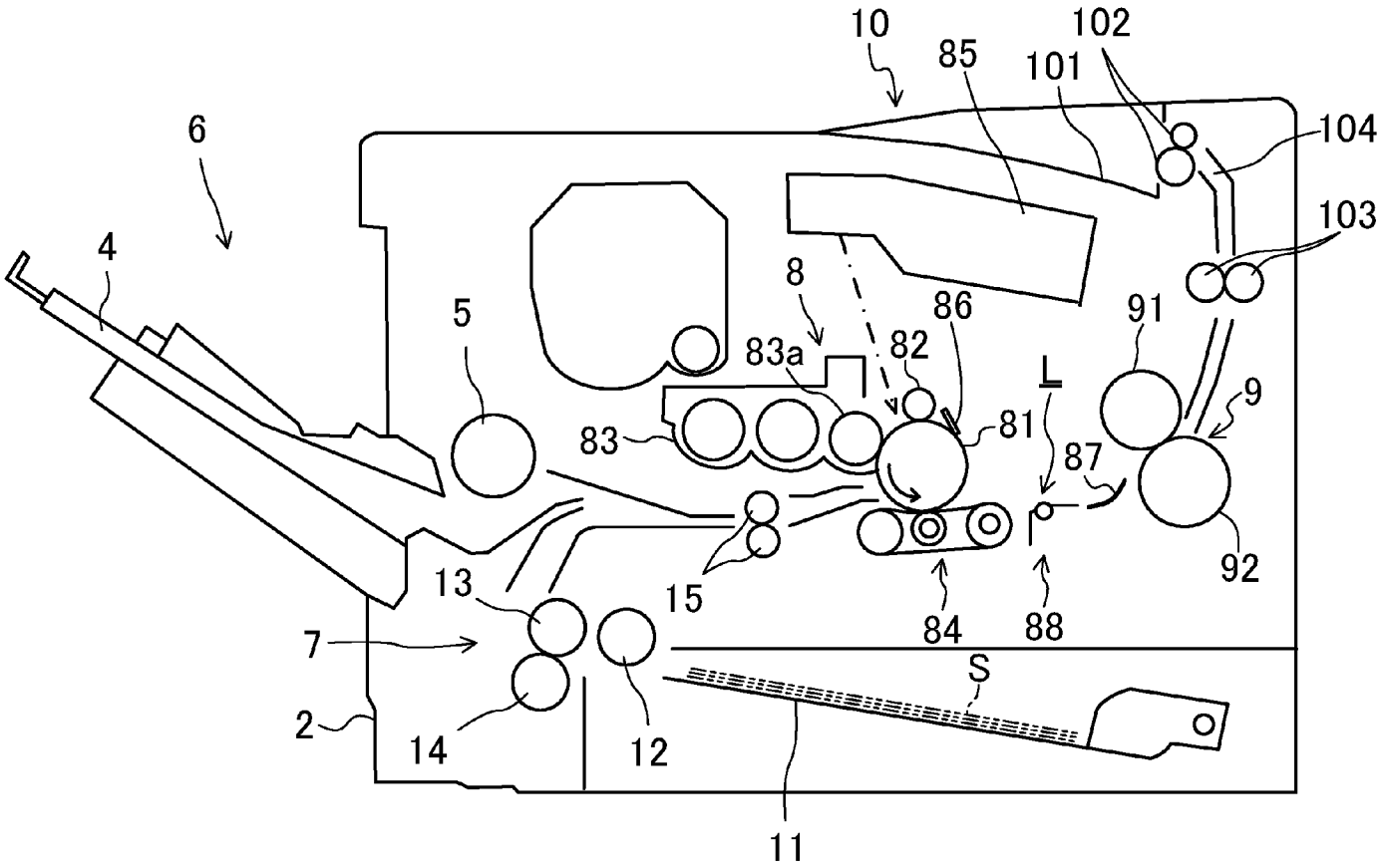
FIG. 1 is a schematic diagram illustrating an image forming apparatus in an embodiment.

FIG. 1 is a sectional view illustrating a schematic configuration of a laser printer 1 as an image forming apparatus 1 in an embodiment.

As illustrated in FIG. 1, the laser printer 1 includes a box-like printer body 2, a manual paper feeding unit 6, a cassette paper feeding unit 7, an image forming unit 8, a fixing unit 9, and a paper discharge unit 10. The laser printer 1 is configured to form an image on a sheet S on the basis of image data transmitted from a terminal and the like (not illustrated) while conveying the sheet S along a conveyance path L in the printer body 2.

The manual paper feeding unit 6 has a manual tray 4 provided at one side portion of the printer body 2 so as to be openable and closable, and a manual paper feeding roller 5 provided in the printer body 2 so as to be rotatable.

The cassette paper feeding unit 7 is provided at a bottom portion of the printer body 2. The cassette paper feeding unit 7 includes a paper feeding cassette 11 that stores a plurality of sheets S overlapped one another, a pick roller 12 that takes out the sheets S in the paper feeding cassette 11 one by one, and a feed roller 13 and a retard roller 14 that separate the taken-out sheets S one by one and send the separated sheet to the conveyance path L.

The image forming unit 8 is provided above the cassette paper feeding unit 7 in the printer body 2. The image forming unit 8 includes a photosensitive drum 81 serving as an image carrying member provided in the printer body 2 so as to be rotatable, a charging device 82, a developing device 83, a transfer device 84, and an optical scanning device 85 arranged above the photosensitive drum 81, wherein the charging device 82, the developing device 83, and the transfer device 84 are arranged around the photosensitive drum 81. It is noted that a reference numeral 86 of FIG. 1 indicates a cleaning blade for removing remaining toner attached to the photosensitive drum 81.

At the aforementioned conveyance path L, a resist roller pair 15 is provided to temporarily keep the taken-out sheet waiting and then supply the sheet to the image forming unit 8 at a predetermined timing.

The fixing unit 9 is arranged at a lateral side of the image forming unit 8. The fixing unit 9 includes a fixing roller 91 and a pressure roller 92, which rotate in press-contact with each other.

The paper discharge unit 10 is provided above the fixing unit 9. The paper discharge unit 10 includes a paper discharge tray 101, a paper discharge roller pair 102 for conveying the sheet S to the paper discharge tray 101, and a conveying roller pair 103 and a conveying guide 104 for feeding the sheet S to the paper discharge roller pair 102.

When the image forming unit 8 receives image data, the photosensitive drum 81 is rotationally driven by a motor (not illustrated) and the surface of the photosensitive drum 81 is charged to a predetermined potential by the charging device 82. In the present embodiment, the charging device 82 charges the surface of the photosensitive drum 81 to a positive polarity. Accordingly, after the surface of the photosensitive drum 81 is charged, laser light is emitted from the optical scanning device 85 to the photosensitive drum 81 on the basis of predetermined image data. The laser light is irradiated, so that an electrostatic latent image is formed on the surface of the photosensitive drum 81. The electrostatic latent image formed on the photosensitive drum 81 is developed by toner charged in the developing device 83. In this way, the electrostatic latent image is visualized as a toner image. In the present embodiment, a toner image is formed by so-called reversal development and the charged polarity of the toner charged in the developing device 83 becomes a positive polarity. It is noted that a toner image may also be formed by normal development as well as the reversal development, and in this case, the charged polarity of the toner becomes a negative polarity.

After the toner image is formed on the surface of the photosensitive drum 81, the sheet S sent from the resist roller pair 15 is pressed to the surface of the photosensitive drum 81 by the transfer device 84. Then, a transfer voltage with a charged polarity (a negative polarity in the present embodiment) opposite to the toner polarity is applied to the sheet S by the transfer device 84, so that the toner image of the photosensitive drum 81 is transferred to the sheet S. The sheet S with the transferred toner image is heated and pressed by the fixing roller 91 and the pressure roller 92 in the fixing unit 9. As a consequence, the toner image is fixed to the sheet S.

Figure 2:
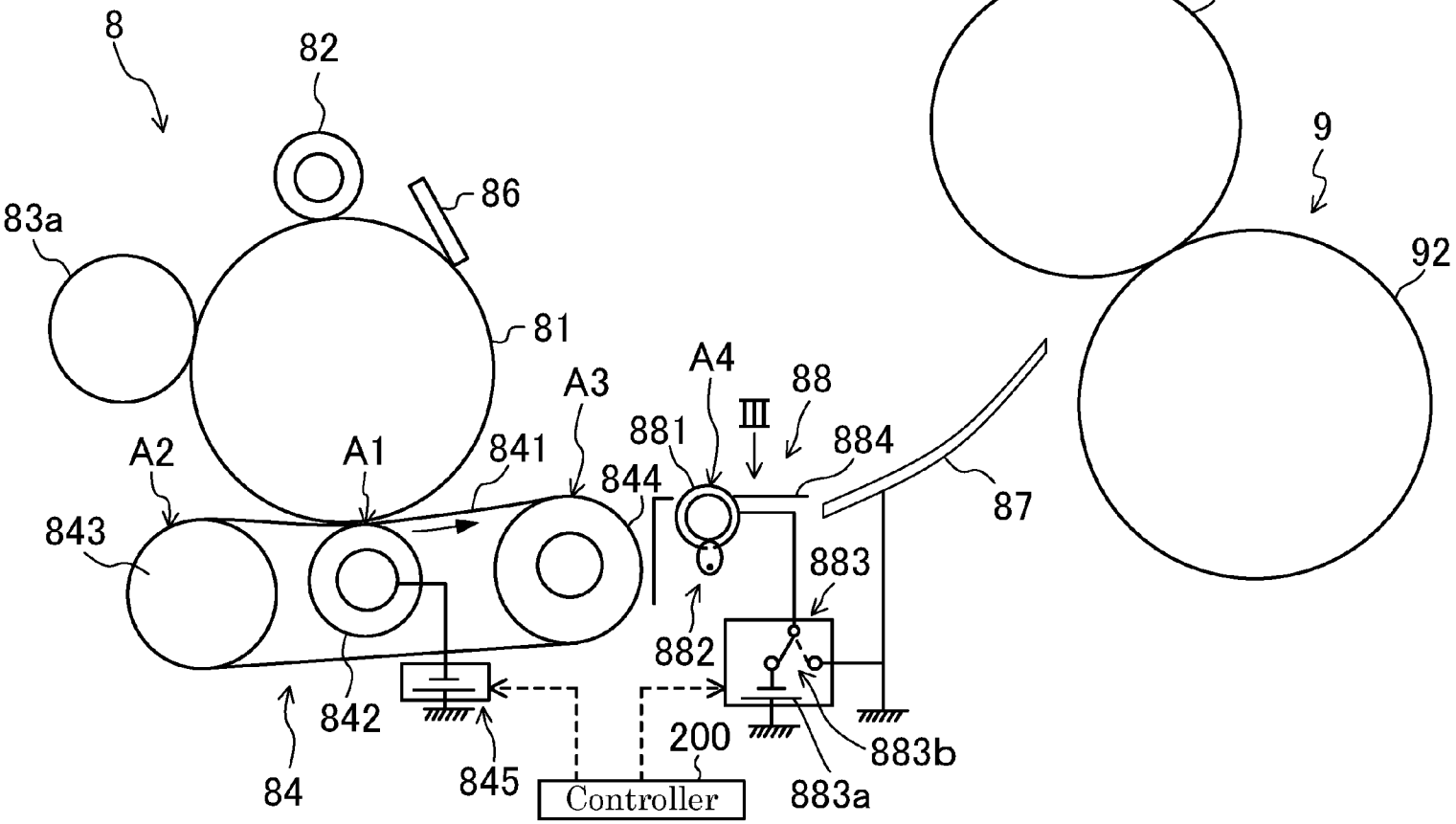
FIG. 2 is an enlarged schematic diagram illustrating an image forming unit.

As illustrated in FIG. 2, the transfer device 84 has an endless conveying belt 841, a transfer roller 842, an upstream side roller 843, a downstream side roller 844, and a transfer voltage application unit 845.

The conveying belt 841 conveys the sheet S while allowing the sheet S to be electrostatically attracted to an outer peripheral surface thereof. The outer peripheral surface of the conveying belt 841 forms a nip between the photosensitive drum 81 and the outer peripheral surface in contact with the photosensitive drum 81. The conveying belt 841 is stretched to the upstream side roller 843 and the downstream side roller 844 at a predetermined tension. The conveying belt 841 is driven in the direction indicated by an arrow of FIG. 2 when the upstream side roller 843 or the downstream side roller 844 is rotationally driven by a motor (not illustrated). The conveying belt 841, for example, is formed by coating fluorine-based resin on an outer peripheral surface of a belt-like member made of rubber.

The transfer roller 842 is arranged facing the photosensitive drum 81. An outer peripheral surface of the transfer roller 842 is in contact with an inner peripheral surface of the conveying belt 841. The transfer roller 842 is brought into press-contact with the photosensitive drum 81 with a predetermined load while interposing the conveying belt 841 between the photosensitive drum 81 and the transfer roller 842. In this way, the sheet S is nipped between the conveying belt 841 and the photosensitive drum 81 at a nip position A1.

The transfer roller 842 is connected to the transfer voltage application unit 845. The transfer voltage application unit 845 applies a transfer voltage with a polarity opposite to the charged polarity of the toner to the sheet S passing through the nip position A1, thereby transferring the toner image to the sheet S. The transfer voltage application unit 845 is controlled by a controller 200.

The upstream side roller 843 stretches the conveying belt 841 at a conveyance start position A2. The conveyance start position A2 is on an upstream side in the sheet conveyance direction of the nip position A1 and is a position at which a front end of the sheet S comes to the conveying belt 841. The upstream side roller 843 is formed with a conductive member such as a metal, and is grounded via a bearing and the like. It is noted that in the present embodiment, the front end and the rear end of the sheet S indicate the front end and the rear end of the sheet S in the sheet conveyance direction.

The downstream side roller (a stretching roller) 844 stretches the conveying belt at a separation position A3. The separation position A3 is a downstream side in the sheet conveyance direction of the nip position A1 and is a position at which the rear end of the sheet S is separated from the conveying belt 841. The downstream side roller 844 is formed with a conductive member such as a metal.

At the downstream side in the sheet conveyance direction of the downstream side roller 844, a guide unit 87 having an arc plate shape is provided. The guide unit 87 leads the sheet S, which has been separated from the conveying belt 841 at the separation position A3, to the fixing unit 9. The guide unit 87 is configured with a conductive member such as a metal. The guide unit 87 is grounded in the present embodiment.

Between the guide unit 87 and the downstream side roller 844, a conveyance auxiliary unit 88 is provided to assist the conveyance of the sheet S directed to the fixing unit 9 from the conveying belt 841. The conveyance auxiliary unit 88 is provided at an end portion of the downstream side roller 844 side in the conveyance path L between the downstream side roller 844 and the fixing unit 9.

The conveyance auxiliary unit 88 has a conveyance auxiliary roller 881, auxiliary roller driving parts 882, a voltage application part 883, and an auxiliary guide plate 884. The voltage application part 883 is configured to be able to apply a voltage to the conveyance auxiliary roller 881. The voltage application part 883 has a power source 883*a* and a switching switch 883*b*. A negative electrode side terminal of the power source 883*a* is connected to the conveyance auxiliary roller 881 and a positive electrode side terminal of the power source 883*a* is grounded. Accordingly, the power source 883*a* is able to apply a voltage (a voltage with a negative polarity) opposite to the charged polarity (a positive polarity in the present embodiment) of the toner to the conveyance auxiliary roller 881. The switching switch 883*b* switches the conveyance auxiliary roller 881 to a power supply conduction state and a ground state. In the power supply conduction state (in a state in which the switching switch 883*b* is in a position indicated by a solid line in FIG. 2), the conveyance auxiliary roller 881 and the power source 883*a* are electrically connected to each other, but in the ground state (in a state in which the switching switch 883*b* is in a position indicated by a dashed line in FIG. 2), the conveyance auxiliary roller 881 is grounded because the aforementioned connection is blocked.

An operation of the switching switch 883*b* is controlled by the controller 200. The controller 200 controls the switching switch 883*b*, thereby controlling a voltage to be applied to the conveyance auxiliary roller 881 from the voltage application part 883. Details of the voltage application control by the controller 200 will be described later.

Figure 3:
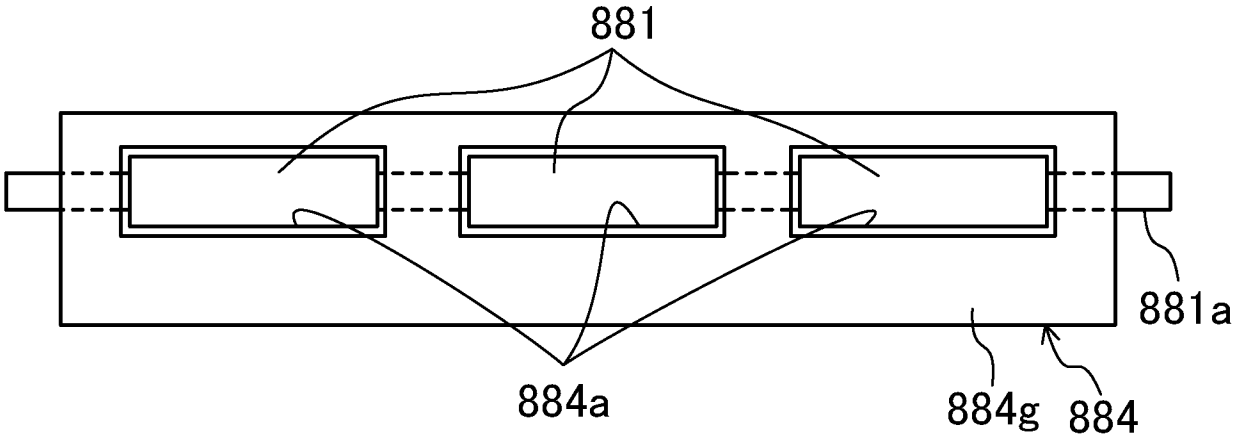
FIG. 3 is a view viewed in the arrow direction of III of FIG. 2.

The conveyance auxiliary roller 881 assists the conveyance of the sheet S at an auxiliary conveyance position A4 in the vicinity of a downstream side of the separation position A3. The conveyance auxiliary roller 881, for example, is configured with a rubber member having a resistance value of $10^8\Omega$ to $10^9\Omega$. As illustrated in FIG. 3, the conveyance auxiliary roller 881 is divided into three in an axial direction. These three conveyance auxiliary rollers 881 are arranged while being spaced apart from one another in the axial direction and are supported coaxially to a shaft 881*a*. Both end portions of the shaft 881*a* are supported by bearings 881*b* (illustrated only in FIG. 5) so as to be rotatable.

The conveyance auxiliary roller 881 is exposed to the conveyance path L from an upper surface portion of the auxiliary guide plate 884. The aforementioned auxiliary guide plate 884 is formed in a sectional L shape. A guide plate part 884*g* of the auxiliary guide plate 884, which extends along the conveyance path L, is formed with three openings 884*a*. The three openings 884*a* are formed while being spaced apart from one another in a direction perpendicular to the conveyance path L. Each of the three openings 884*a* receives the conveyance auxiliary roller 881 such that the conveyance auxiliary roller 881 is movable in a vertical direction.

Figure 4:
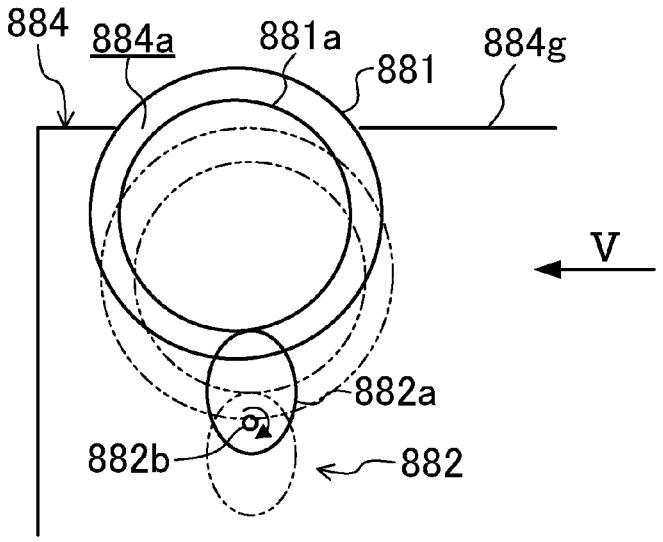
FIG. 4 is a schematic diagram illustrating a driving part of a conveyance auxiliary roller when viewed from an axial direction.

As illustrated in FIG. 4, the auxiliary roller driving part 882 drives the conveyance auxiliary roller 881 in the vertical direction between a first position (a position indicated by a solid line of FIG. 4) and a second position (a position indicated by a two dot chain line of FIG. 4). In the first position, an upper end portion of the conveyance auxiliary roller 881 protrudes upward from a conveyance surface of the guide plate part 884*g*. It is noted that the entire conveyance auxiliary roller 881 may also protrude upward from the conveyance surface. In the second position, the upper end of the conveyance auxiliary roller 881 and the conveyance surface of the guide plate part 884*g* are positioned at the same height.

Figure 5:
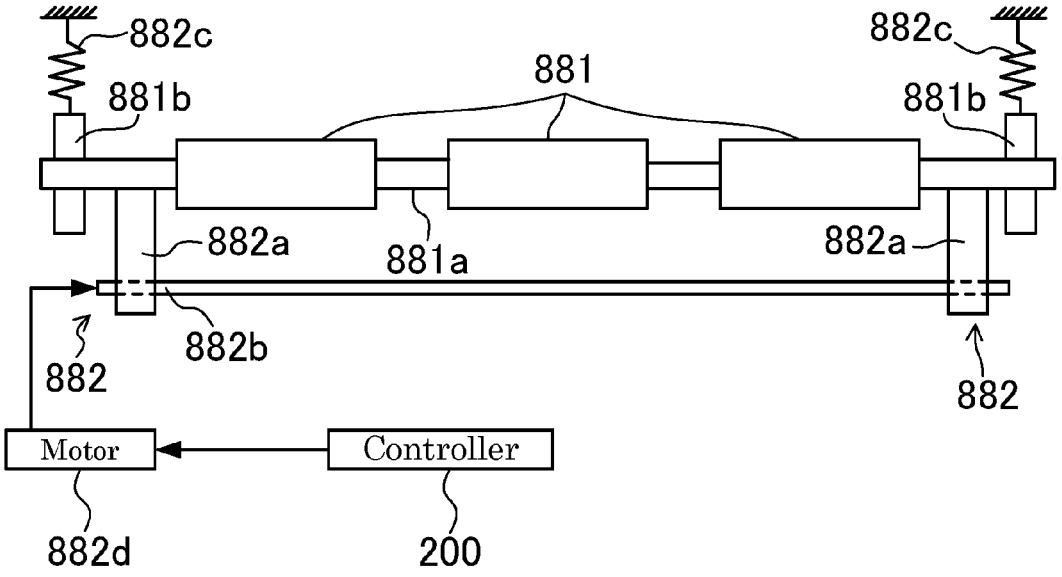
FIG. 5 is a view viewed in the arrow direction of V of FIG. 4.

With reference to FIG. 4 and FIG. 5, a detailed configuration of the auxiliary roller driving part 882 will be described. The auxiliary roller driving parts 882 are respectively provided at both end portions of the shaft 881*a* that supports the conveyance auxiliary roller 881.

Each auxiliary roller driving part 882 has rotating cams 882*a*, a support shaft 882*b*, and urging springs 882*c* (illustrated only in FIG. 5). Each rotating cam 882*a* includes a plate cam having an oval shape and is arranged such that its outer peripheral surface abuts the shaft 881*a* from below.

The support shaft 882*b* extends in parallel to the shaft 881*a* of the conveyance auxiliary roller 881. The rotating cams 882*a* are fixed to end portions in the axial direction of the support shaft 882*b* and rotate together with the support shaft 882*b*. The urging springs 882*c* are connected to the bearings 881*b* that support both end portions of the shaft 881*a*. Furthermore, the urging springs 882*c* always urge the shaft 881*a* in a downward direction via the bearings 881*b*.

The aforementioned support shaft 882*b* is rotationally driven by a motor 882*d*. In the state (the state indicated by the solid line of FIG. 4) in which the conveyance auxiliary roller 881 is in the first position, maximum diameter portions of the rotating cams 882*a* abut the shaft 881*a*. When the rotating cams 882*a* are rotated by the motor 882*d* by 180° together with the support shaft 882*b* from this state, minimum diameter portions of the rotating cams 882*a* abut the shaft 881*a*, so that the conveyance auxiliary roller 881 moves to the second position below the first position. The aforementioned motor 882*d* is controlled by the controller 200. The controller 200 controls the conveyance auxiliary roller 881 to be positioned at the aforementioned first position up to a predetermined time immediately before the rear end of the sheet S passes through the separation position A3, and controls the motor 882*d* such that the conveyance auxiliary roller 881 is positioned at the aforementioned second position after the predetermined time.

Figure 6:
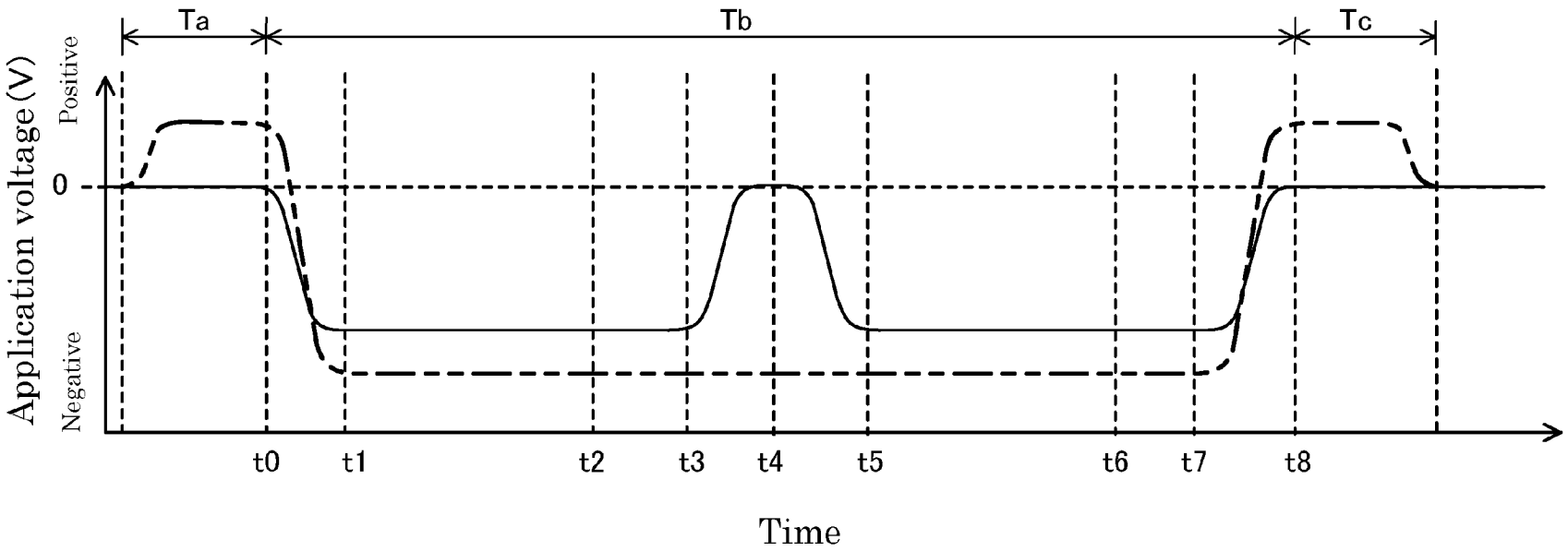
FIG. 6 is a graph illustrating a time change in an application voltage of a transfer roller and an application voltage of a conveyance auxiliary roller.

Next, with reference to the time chart of FIG. 6, details of the control of voltage application to the conveyance auxiliary roller 881 by the controller 200 will be described. A line indicated by a two dot chain line of FIG. 6 indicates a change in a voltage which is applied to the transfer roller 842, and a line indicated by a solid line indicates a change in a voltage which is applied to the conveyance auxiliary roller 881. This time chart shows an example in which continuous printing has been performed for two sheets S. The following description can be provided by dividing the time chart into three sections of two standby sections Ta and Tc and one job execution section Tb. The standby section Ta is a section immediately after the printer 1 is powered on and before a print job is received, the job execution section Tb is a section in which the print job is being executed, and the standby section Tc is a section immediately before the execution of the print job is ended and the printer 1 is switched to a sleep mode.

Firstly, an application voltage (see the two dot chain line) to the transfer roller 842 will be described. In the standby section Ta, a voltage with the same polarity as charged polarity of toner is applied to the transfer roller 842. In this way, scattered toner is prevented from being attached to the transfer roller 842 and the conveying belt 841 contacting with the transfer roller 842. After the standby section Ta, when the image forming unit 8 receives a print job at a time t0 at which the job execution section Tb starts, the application voltage to the transfer roller 842 starts to be reduced. Before a front end of the first sheet S reaches the nip position A1 at a time t1, the application voltage to the transfer roller 842 is switched to a polarity (a negative polarity in the present embodiment) opposite to the charged polarity of the toner. In this way, it is possible to move the toner image on the photosensitive drum 81 to the sheet S which passes through the nip position A1. Thereafter, until a rear end of the second sheet passes through the nip position A1 at a time t7, the application voltage to the transfer roller 842 is constantly maintained. After the time t7, the application voltage to the transfer roller 842 starts to increase. Up to a time t8 at which the standby section Tc starts, the application voltage to the transfer roller 842 is switched to a polarity (a positive polarity in the present embodiment) equal to the charged polarity of the toner.

Next, an application voltage (see the solid line) to the conveyance auxiliary roller 881 will be described. In the standby section Ta, a ground voltage has been applied to the conveyance auxiliary roller 881 (that is, conveyance auxiliary roller 881 has been grounded). After the standby section Ta, when a print job is received at the time t0 at which the job execution section Tb starts, the application voltage to the conveyance auxiliary roller 881 starts to be reduced. Before the front end of the first sheet S reaches the nip position A1 at the time t1, the application voltage to the conveyance auxiliary roller 881 is switched to the polarity (the negative polarity in the present embodiment) opposite to the charged polarity of the toner. Thereafter, until the rear end of the first sheet S passes through the nip position A1 at the time t2 and passes through the separation position A3 at the time t3, the application voltage to the conveyance auxiliary roller 881 is constantly maintained. After the time t3, the application voltage to the conveyance auxiliary roller 881 starts to increase. Before the rear end of the sheet S passes through the auxiliary conveyance position A4 at the time t4, the application voltage to the conveyance auxiliary roller 881 is switched to the ground voltage. After the time t4, the application voltage to the conveyance auxiliary roller 881 starts to be reduced in order to prepare the printing of the second sheet. At a time t5 to a time t8, voltage control similar to that at the time t1 to the time t4 is performed in a print operation of the second sheet S. In the standby section Tc after the time t8, the application voltage to the conveyance auxiliary roller 881 is maintained to the ground voltage. It is noted that in the standby sections Ta and Tc, a voltage with the same polarity as the toner may also be applied to the conveyance auxiliary roller 881. In this way, it is possible to prevent scattered toner from being attached to the conveyance auxiliary roller 881.

As described above, in the aforementioned embodiment, the controller 200 switches the polarity of the application voltage to the conveyance auxiliary roller 881 to a polarity opposite to the charged polarity of the toner up to the time t1 at which the front end of the sheet S reaches the nip position A1. Consequently, after the time t1, when the front end of the sheet S makes contact with the conveyance auxiliary roller 881, the application voltage to the conveyance auxiliary roller 881 already has the polarity opposite to the charged polarity of the toner, in other words, the application voltage to the conveyance auxiliary roller 881 has the same polarity as the entire charged polarity of the sheet S. Consequently, it is possible to prevent discharge from occurring by a large potential difference between the sheet S and the conveyance auxiliary roller 881 when they have made contact with each other. Thus, it is possible to prevent the scattering of toner due to the discharge when the sheet S and the conveyance auxiliary roller 881 make contact with each other.

Moreover, the controller 200 is configured to switch the application voltage to the conveyance auxiliary roller 881 to the ground voltage (0 V) before the rear end of the sheet S is separated from the conveyance auxiliary roller 881 after being separated from the conveying belt 841 (between the times t3 and t4). Consequently, it is possible to prevent the rear end of the sheet S from jumping up due to electrical repulsion between the sheet S and the conveyance auxiliary roller 881 when the rear end of the sheet S is separated from the conveyance auxiliary roller 881 at the time t4. Thus, it is possible to suppress the scattering of toner due to the jumping-up of the rear end of the sheet S.

Furthermore, the controller 200 is configured to maintain the conveyance auxiliary roller 881 to have a polarity opposite to the charged polarity of the toner until the rear end of the sheet S is separated from the conveying belt 841 (at the time t3). Consequently, the toner is electrically attracted and held to the sheet S during this time, so that it is possible to reliably prevent the scattering of toner.

Figure 7A:
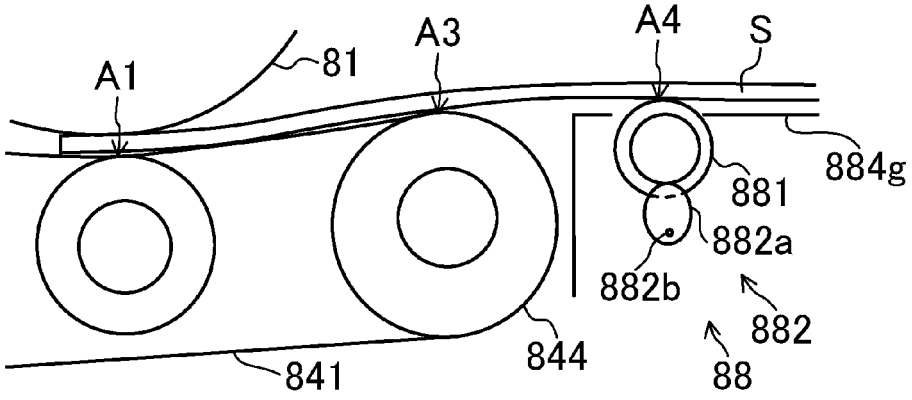
FIG. 7A is an explanation diagram for explaining an operation of a conveyance auxiliary roller, and illustrates a state before a rear end of a sheet is separated from a conveying belt.
Figure 7B:
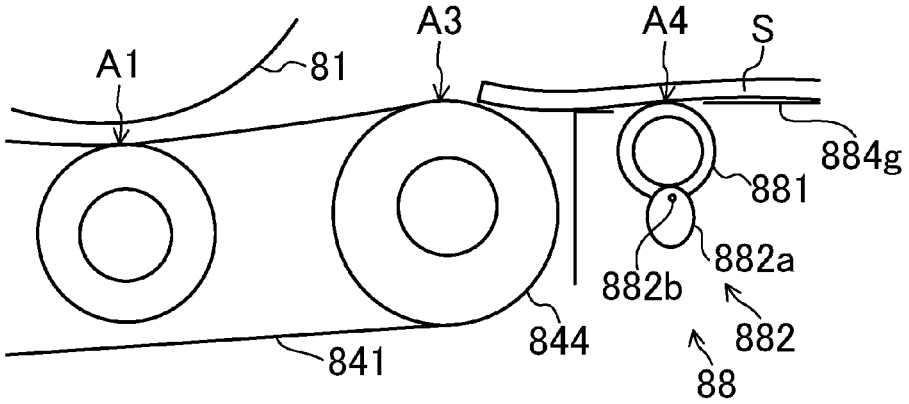
FIG. 7B is an explanation diagram for explaining an operation of a conveyance auxiliary roller, and illustrates a state immediately after a rear end of a sheet is separated from a conveying belt.
Figure 7C:
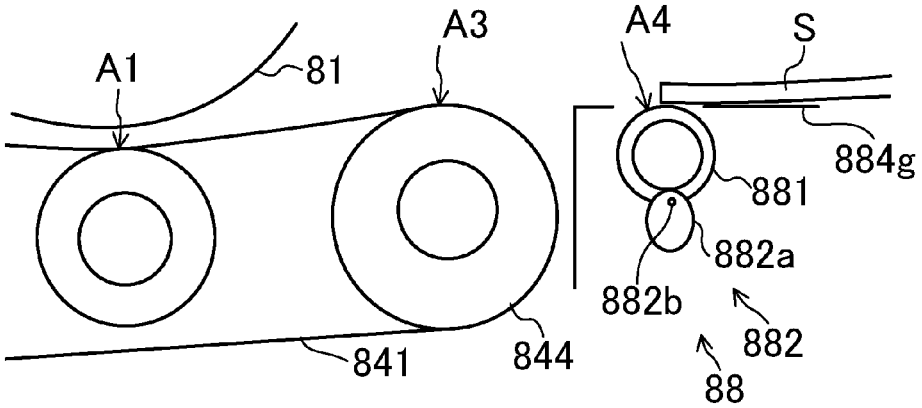
FIG. 7C is an explanation diagram for explaining an operation of a conveyance auxiliary roller, and illustrates a state immediately before a rear end of a sheet is separated from a conveyance auxiliary roller.

Moreover, the controller 200 is configured to control the conveyance auxiliary roller 881 to be positioned at the aforementioned first position up to a predetermined time immediately before the rear end of the sheet S passes through the separation position A3 (see FIG. 7A), and to control the conveyance auxiliary roller 881 to be positioned at the second position after the predetermined time (see FIG. 7B and FIG. 7C). Consequently, as illustrated in FIG. 7A, while the sheet S is being conveyed across the conveying belt 841 and the conveyance auxiliary unit 88, the sheet S is held to the upper side by the conveyance auxiliary roller 881 as much as possible to stabilize the conveyance attitude of the sheet S, and when the rear end of the first sheet S passes through the separation position A3, the sheet S is supported to the lower side by the conveyance auxiliary roller 881 as much as possible, so that it is possible to prevent the rear end of the sheet S from jumping up. Thus, it is possible to prevent the scattering of toner due to the jumping-up of the rear end of the sheet S.

Other Embodiments

Figure 8:
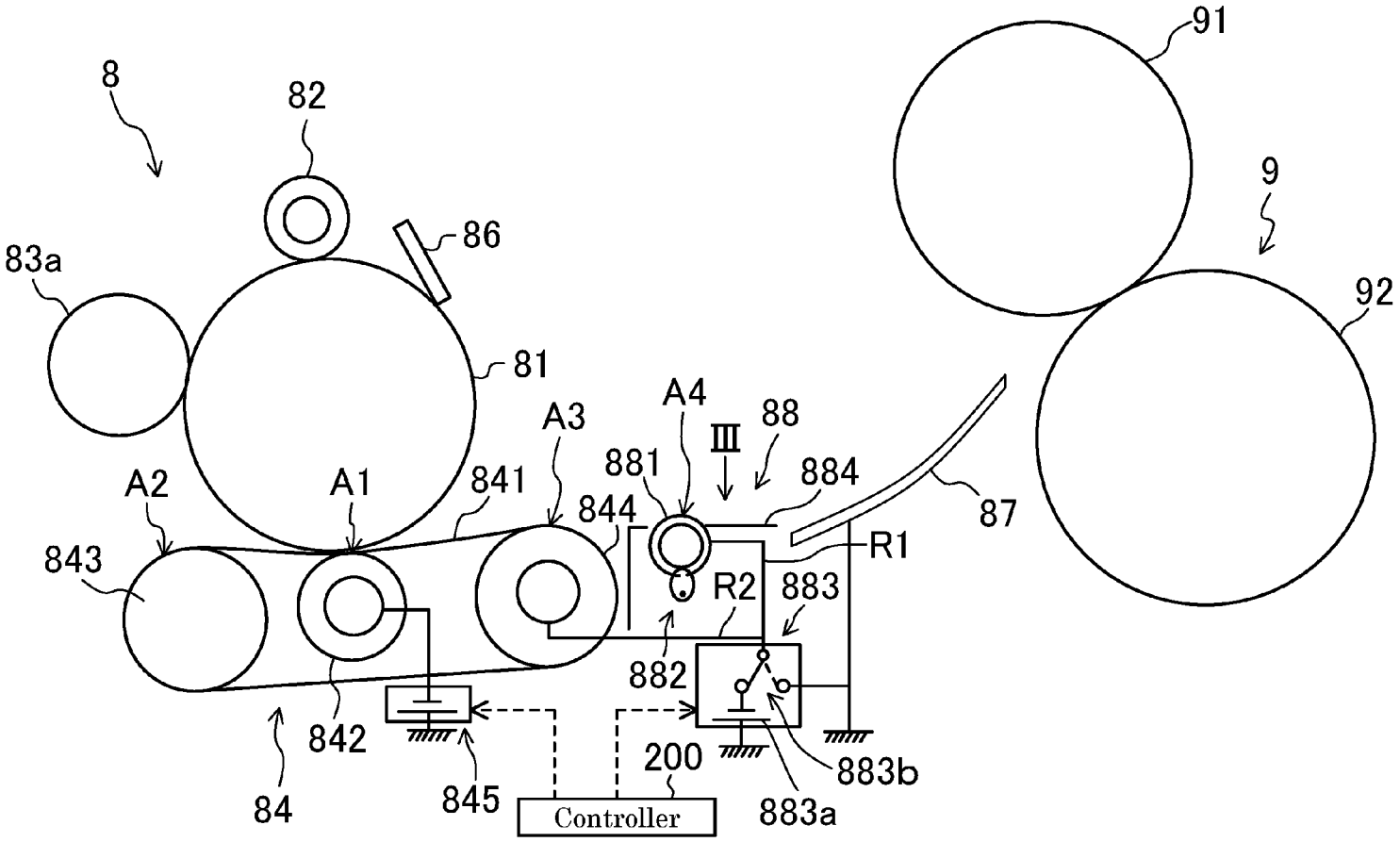
FIG. 8 is a diagram corresponding to FIG. 2, which illustrates another embodiment.

In the aforementioned embodiment, a voltage is configured to be applied to only the conveyance auxiliary roller 881 by the voltage application part 883; however, the present invention is not limited thereto and a voltage having the same waveform as that of the conveyance auxiliary roller 881 may also be further applied to the downstream side roller 844. In this case, for example, as illustrated in FIG. 8, it is sufficient if a branch line R2 is allowed to be branched from a connection line R1 for connecting the conveyance auxiliary roller 881 and the voltage application part 883 to each other and to be connected to the downstream side roller 844. In this way, it is possible to prevent separation discharge when the sheet S is separated from the conveying belt 841 and thus to prevent the scattering of toner due to the separation discharge while obtaining operation effects similar to the aforementioned embodiment.

In the aforementioned embodiment, the laser printer 1 has been described as an example of an image forming apparatus; however, the present invention is not limited thereto and the image forming apparatus, for example, may also include a copy machine, a multifunctional peripheral (MFP) and the like.

What is claimed is:

1. An image forming apparatus comprising:

an image carrying member that carries a toner image;

a conveying belt that forms a nip in contact with the image carrying member and conveys a sheet via a nip position;

a transfer roller that transfers the toner image to the sheet at the nip position;

a stretching roller that stretches the conveying belt at a downstream side in a sheet conveyance direction of the nip position;

a conveyance auxiliary roller provided in a vicinity of a downstream side of the stretching roller and supporting the sheet from below;

a voltage application part that applies a voltage to the conveyance auxiliary roller;

a control unit that controls an application voltage which is applied to the conveyance auxiliary roller by the voltage application part;

a guide plate part formed with an opening that receives the conveyance auxiliary roller so that the conveyance auxiliary roller is movable in a vertical direction within the opening and provided along a conveyance path of the sheet; and a driving part that drives the conveyance auxiliary roller between a first position and a second position below the first position, at least a part of the first position protruding upward from the opening, wherein the control unit is configured to control the application voltage to the conveyance auxiliary roller to have a polarity opposite to a charged polarity of toner before a front end of the sheet makes contact with the conveyance auxiliary roller, and to switch the application voltage to the conveyance auxiliary roller to a ground voltage before a rear end of the sheet is separated from the conveyance auxiliary roller after being separated from the conveying belt, and wherein the control unit controls the conveyance auxiliary roller to be positioned at the first position by the driving part up to a predetermined time immediately before the rear end of the sheet is separated from the conveying belt, and controls the driving part such that the conveyance auxiliary roller is positioned at the second position after the predetermined time.

2. The image forming apparatus of claim 1, wherein the voltage application part is further configured to be able to apply a voltage to the stretching roller, and the control unit is further configured to apply, to the stretching roller, a voltage having a waveform equal to a waveform of the application voltage to the conveyance auxiliary roller.

* * * * *